US009764355B2

(12) United States Patent
Beslin et al.

(10) Patent No.: US 9,764,355 B2
(45) Date of Patent: Sep. 19, 2017

(54) ACOUSTIC PROJECTOR SYSTEM WITH NON-UNIFORM SPACING

(71) Applicant: Ultra Electronics Maritime Systems Inc., Dartmouth (CA)

(72) Inventors: Olivier Beslin, Eastern Passage (CA); James Crawford, Dartmouth (CA); Matthew Gerard Mallay, Halifax (CA)

(73) Assignee: Ultra Electronics Maritime Systems Inc., Dartmouth, NS (CA)

( * ) Notice: Subject to any disclaimer, the term of this patent is extended or adjusted under 35 U.S.C. 154(b) by 165 days.

(21) Appl. No.: 14/708,610

(22) Filed: May 11, 2015

(65) Prior Publication Data

US 2016/0336000 A1 Nov. 17, 2016

(51) Int. Cl.
*B01B 1/00* (2006.01)
*B06B 1/06* (2006.01)

(52) U.S. Cl.
CPC ..... *B06B 1/0611* (2013.01)

(58) Field of Classification Search
CPC ..... B06B 1/0611; B06B 1/0618; H04R 1/44
See application file for complete search history.

(56) References Cited

U.S. PATENT DOCUMENTS 3,289,114 A * 11/1966 Rowen ..... G10K 11/36 333/150
4,797,682 A * 1/1989 Klimczak ..... H01Q 21/22 343/770
5,278,757 A * 1/1994 Hoctor ..... G01S 15/8997 600/459
5,701,277 A 12/1997 Ring
2007/0161904 A1* 7/2007 Urbano ..... A61B 8/00 600/459
2008/0056069 A1 3/2008 Doisy
2008/0566069 3/2008 Doisy
2009/0268554 A1 10/2009 Armstrong

OTHER PUBLICATIONS

Moffet, Minimum Redundancy Linear Arrays, IEEE Transactions on Antennas and propagation, vol. AP-16, No. 2 Mar. 1968, pp. 172-175.*
Ruf, Numerical Annealing of Low-Redundancy Linear Arrays, IEEE Transactions on Antennas and propagation, vol. 41, No. 1, Jan. 1993, pp. 85-90.*
EESR dated Sep. 9, 2016.

* cited by examiner

*Primary Examiner* — Hovhannes Baghdasaryan
(74) *Attorney, Agent, or Firm* — Rowand LLP

(57) ABSTRACT

An underwater acoustic projector system that includes a linear array of acoustic projectors in close proximity such that the acoustic projectors interact with one another when they produce acoustic pressures, wherein each acoustic projector in the linear array is spaced apart from an adjacent acoustic projector by a respective distance, and wherein the respective distance between two acoustic projectors proximate the center of the linear array is greater than the respective distance between two acoustic projectors proximate the end of the linear array.

19 Claims, 8 Drawing Sheets

430

420

ACOUSTIC PROJECTOR SYSTEM WITH NON-UNIFORM SPACING

FIELD

The present application generally relates to acoustic projectors, particularly an acoustic projector system with non-uniform spacing between adjacent projectors in a linear array of projectors.

BACKGROUND

Sound projectors are used in a number of underwater applications. US patent publication no. 2009/0268554, published Oct. 29, 2009, proposed the creation of an acoustic projector system by using a linear array of sound projectors held in close proximity such that the projectors interact with each other. By altering the number of projectors or the spacing between the projectors, the characteristics of the acoustic projector system may be changed to achieve a design objective.

An acoustic projector system formed from a linear array of sound projectors still encounters problems with cavitation depth limitations.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1A:
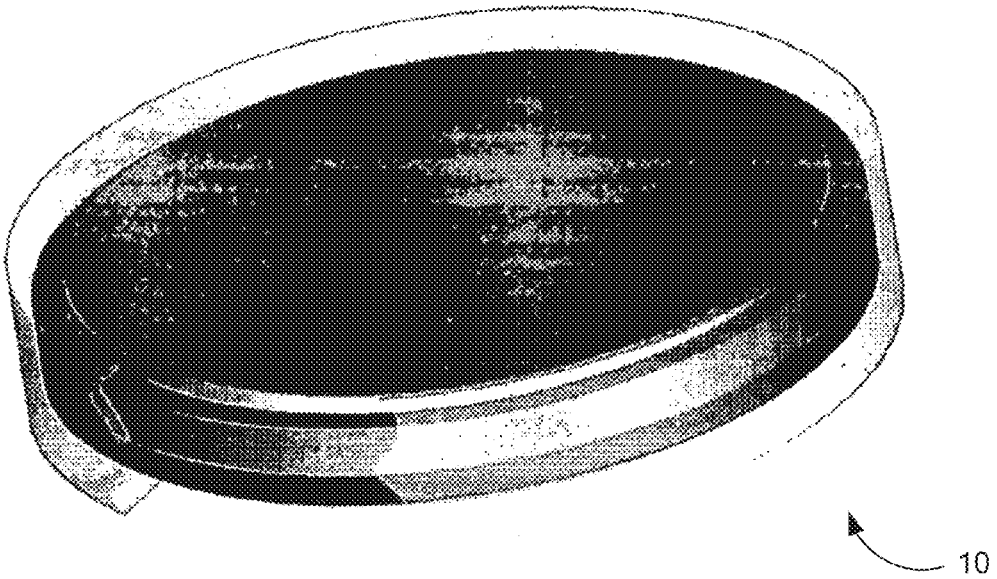
FIGS. 1A and 1B show an example of a cylindrical acoustic projector.

In one aspect, the present application describes an underwater acoustic projector system that includes a plurality of acoustic projectors; and framing that holds the acoustic projectors in a linear array and in close proximity such that the acoustic projectors interact with one another when they produce acoustic pressures, wherein each acoustic projector in the linear array is spaced apart from an adjacent acoustic projector by a respective distance. The respective distance between two acoustic projectors proximate the center of the linear array is greater than the respective distance between two acoustic projectors proximate the end of the linear array.

In another aspect, the present application describes an underwater acoustic projector system. The system includes a linear array of four or more acoustic projectors held in close proximity, wherein each acoustic projector in the linear array is spaced apart from an adjacent acoustic projector by a respective distance. The respective distance between two acoustic projectors proximate the center of the linear array is greater than the respective distance between two acoustic projectors proximate the end of the linear array.

In yet a further aspect, the present application describes an underwater acoustic projector system that includes a plurality of acoustic projection means for generating acoustic waves in water in response to an electric signal, and framing means for holding the acoustic projectors in a linear array and in close proximity such that the acoustic projectors interact with one another when they produce acoustic pressures, wherein each acoustic projector in the linear array is spaced apart from an adjacent acoustic projector by a respective distance. The respective distance between two acoustic projectors proximate the center of the linear array is greater than the respective distance between two acoustic projectors proximate the end of the linear array.

Other aspects and features of the present application will be apparent to those of ordinary skill in the art in light of the following description of example embodiments.

Arrays of acoustic projectors are used in many underwater applications. For example, towed arrays may be used for maritime research, military, and commercial purposes. US patent publication no. 2009/0268554, published Oct. 29, 2009, describes an example underwater system for acoustic sound generation that involves a linear array of acoustic projectors held in close proximity. The term "close proximity", as used in the previous application and in the present application, is defined as (1) the separation between adjacent projectors in the linear array is less than or equal to the characteristic size of the projectors, and (2) the characteristic size of the projectors is small compared to the wavelength of the acoustic resonant frequency of the system. In these examples, the "characteristic size" of a projector is the diameter of an axially-symmetric or spherical projector. The characteristic size may be a physical "size" measurement that relates to the characteristic resistance and reactance of the projector.

The concept described in US patent publication no. 2009/0268554 is that, when the projectors are held in close proximity, the projectors interact with one another via the acoustic pressures each generates. This results in an increase in the radiation impedance (resistance and reactance) each projector meets during deflection of its face plates. By varying the number of projectors and their spacing, the resulting systems have different resonant frequencies, radiated power and cavitation depth. The contents of US patent publication no. 2009/0268554 is incorporated by reference.

Figure 1B:
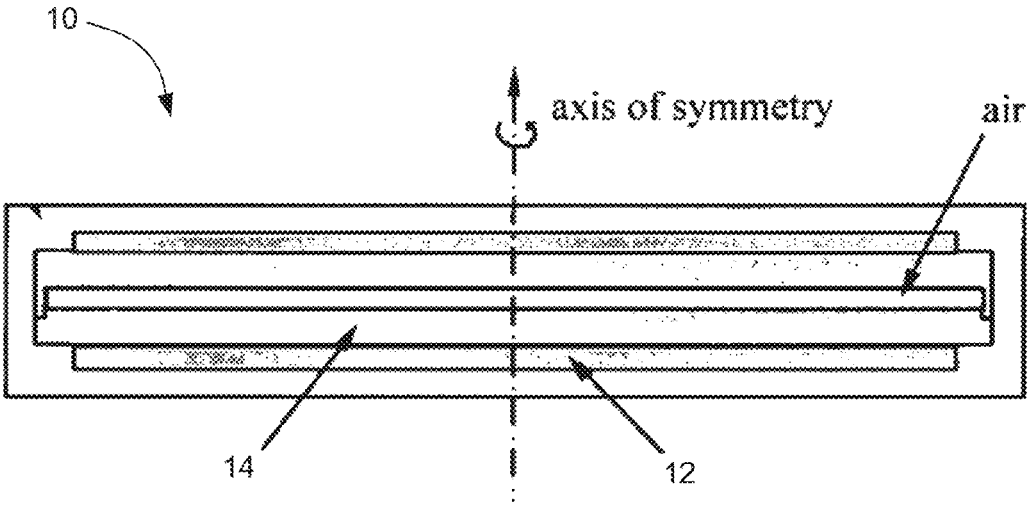

Reference is now made to FIGS. 1A and 1B, which show an example of a cylindrical acoustic projector 10 having two circular piezoelectric ceramic plates 12 attached to two aluminum plates 14. The aluminum plates 14 are spaced apart such that there is an air gap between them. The aluminum plates 14 are held in place at their perimeters in such a way as to permit the plates to bend and deflect. The air gap is sufficient to ensure that the two aluminum plates 14 do not come into contact at maximum deflection. An electrical connection to each of the ceramic plates 12 and the aluminum plates 14 is not shown. Under application of a suitable voltage, the ceramic plates 12 and aluminum plates 14 deflect, generating an acoustic wave in the surrounding water.

The aluminum plates 14 and ceramic plates 12 are encased in a flexible plastic that electrically insulates the projector 10 from surrounding water. In some cases, multiple projectors 10 may be housed within a flexible plastic hose or sleeve, and the projectors 10 held in spaced relation using suitable framing members. The flexible plastic hose or sleeve may be filled with a suitable insulating fluid.

Although the example projector described and shown in FIG. 1 is a flexural disk projector, it will be understood that the present application is not limited to flexural disk projectors. Linear arrays of projectors may use other types of acoustic projectors. For example, in some cases the projectors may be free flooded ring projectors. In another example, the projectors may be ring shell projectors. Other types of acoustic projectors will be familiar to those of ordinary skill in the art. It will therefore be appreciated that the term "acoustic projector" is not intended to be limited to flexural disk projectors in all embodiments.

Figure 2:
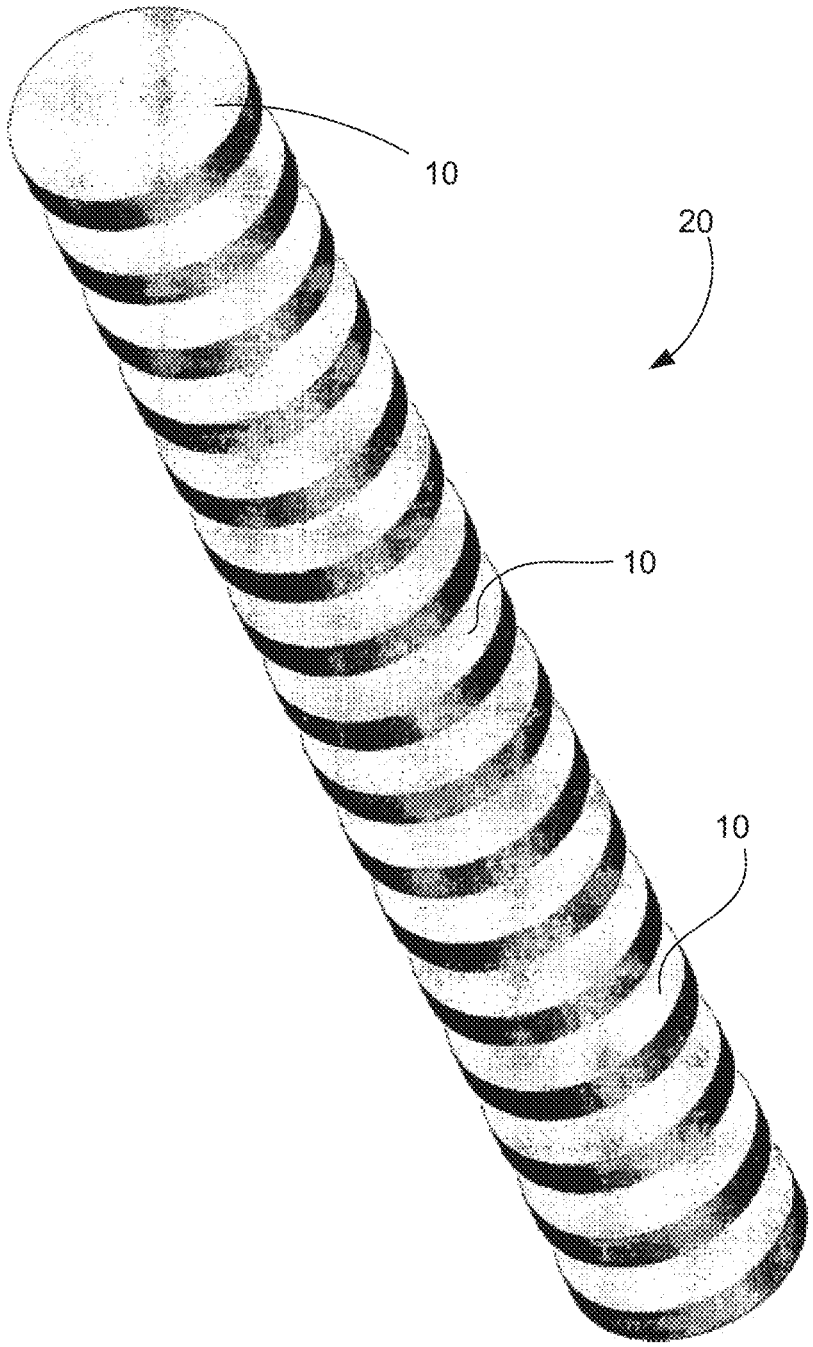
FIG. 2 shows a plurality of acoustic projectors in a linear array.
Figure 3:
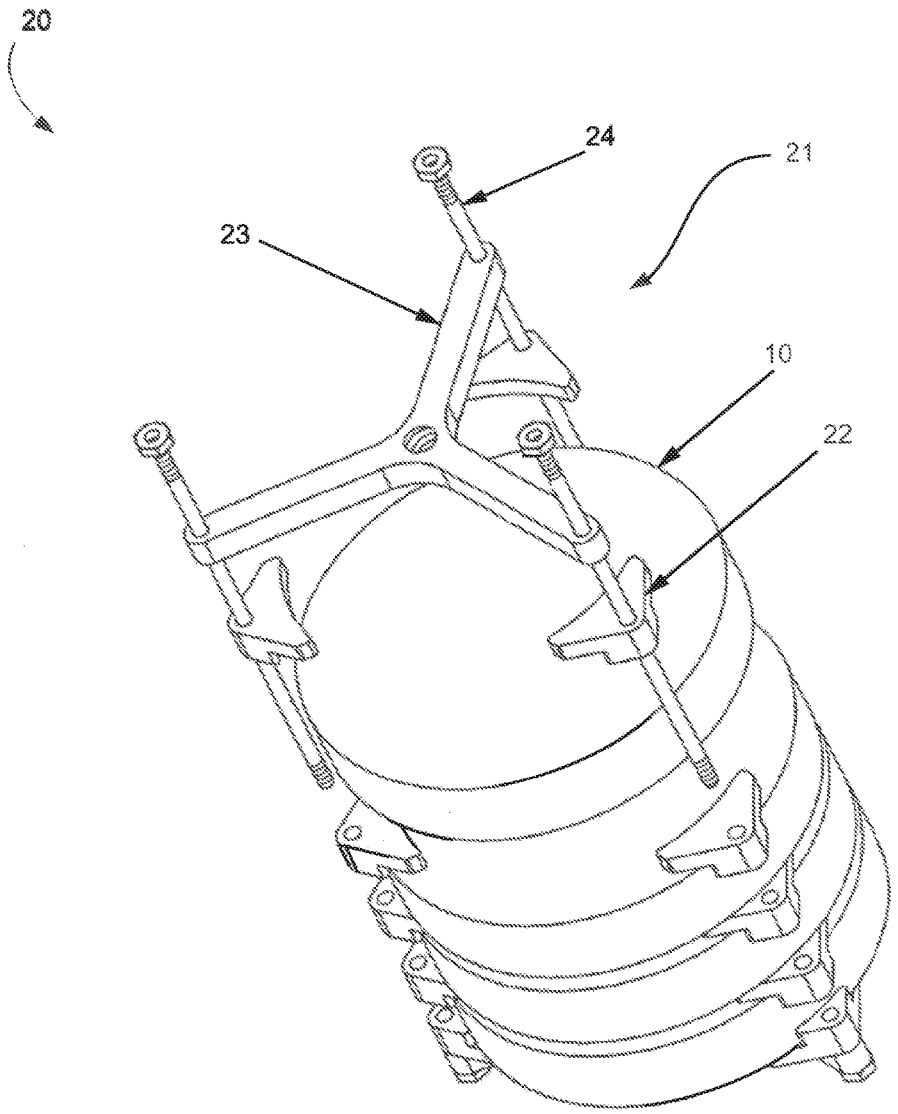
FIG. 3 shows a partially assembled acoustic projector system, including framing.

An example acoustic projector system 20 is shown in FIG. 2. The acoustic projector system 20 includes a plurality of acoustic projectors 10, arranged in a linear array and held in close proximity. It will be appreciated that in some embodiments the system 20 may include fewer or more projectors 10 and that the size and/or distance between projectors 10 may be different in different implementations. FIG. 3 shows a partially assembled acoustic projector system 20. The system 20 includes framing 21, such as spacers 22, rods 24, and frame ends 23, that hold the projectors 10 in spaced relation and in close proximity.

US patent publication no. 2009/0268554 provided examples of acoustic projector systems. In three of the examples, the separation between adjacent projectors was stated to be 25, 50, and 100 mm, respectively. In every example array, the separation between each pair of adjacent projectors was consistent and uniform for the array. That is, the separation between any two adjacent projectors in an array was described as being identical, e.g. spacing between projectors was uniform.

US patent publication no. 2009/0268554 also acknowledges the issue with cavitation. Cavitation occurs during deflection when peak dynamic pressure at the face of the projector exceeds absolute static pressure. This can lead to gasification of surrounding water, creating bubbles. The sudden and dynamic collapse of those bubbles can result in large dynamic pressure forces that damage the face of a projector. Cavitation depth is a measurement of how deep underwater the system must be in order to avoid cavitation for a given source signal. In order to operate in shallower waters, minimizing cavitation depth can be advantageous.

One suggestion for dealing with cavitation is to increase number of projectors to so as to diminish peak pressure on a projector for the same system source level, coupled with wider spacing between projectors to reduce the interaction between adjacent projectors, and, thus, the peak dynamic pressure. By increasing the spacing and increasing the number of projectors it is possible to maintain approximately the same resonant frequency.

Another suggestion for dealing with cavitation is to increase the absolute static pressure by hydrostatically pressurizing the projectors. However, this requires a hermetically-sealed pressure vessel surrounding the projectors and filled with a pressurized fluid. This can be expensive and impractical for some applications.

In one aspect, the present application proposes a different mechanism for addressing the cavitation depth issue in the case of an acoustic projector system. In this aspect of the present application, the acoustic projector system is formed with non-uniform spacing between adjacent projectors. That is, not all pairs of adjacent projectors in the array have the same spacing between them.

In some embodiments all projectors are of the same size and construction and the same voltage is applied to each projector in the array. Under such conditions, each projector attempts to apply same degree of deflection (motion). However, it has been found that not all projectors in the array experience the same impedance. The projectors towards the center experience higher interactive/additive pressures from adjacent projectors than projectors closer to the ends of the array. As a result, the peak dynamic pressure that occurs at the face of one of the projectors near the center of the array is higher than the peak dynamic pressure that occurs at the face of one of the projectors near the end of the array. Accordingly, the cavitation danger is higher for those projectors near the center of the array and they will tend to govern the cavitation depth limits of the system.

In one aspect, the spacing between projectors is made non-uniform by increasing spacing between projectors located proximate the center of the array and decreasing spacing between projectors located proximate the ends of the array. In some circumstances, the resulting linear array of projectors may have the same overall resonant frequency as a similar array with uniform spacing, without the necessity of additional projectors. By increasing the spacing between projectors near the center, the peak dynamic pressure at those projectors is diminished, while decreasing the spacing between projectors near the ends of the array causes the peak dynamic pressure at those projectors to be increased. In some example implementations, by selecting suitable non-uniform spacing between projectors in a linear array of projectors, the peak dynamic pressure on each projectors may be made substantially uniform.

Figure 4A:
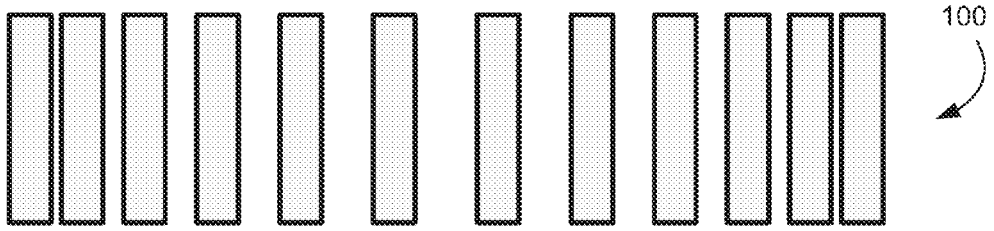
FIG. 4A shows a diagrammatic side view of an example acoustic projector system with non-uniform spacing.
Figure 4B:
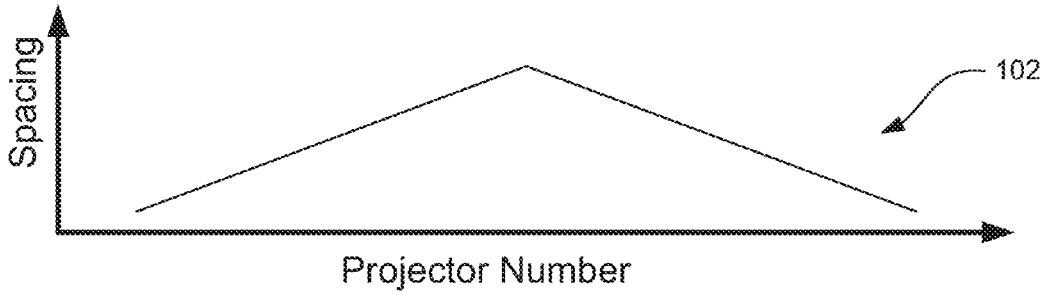
FIG. 4B graphs the spacing between projectors for the example system of FIG. 4A.

Reference is now made to FIG. 4A, which diagrammatically shows one example embodiment of an acoustic projector system 100. The acoustic projector system 100 includes a linear array of projectors 10 with non-uniform spacing between adjacent projectors 10 in the array. FIG. 4B shows a graph 102 illustrating the relative spacing between projectors in the example system 100. The spacing between projectors 10 in this example varies linearly with distance from the center, as shown in the graph 102.

Figure 5A:
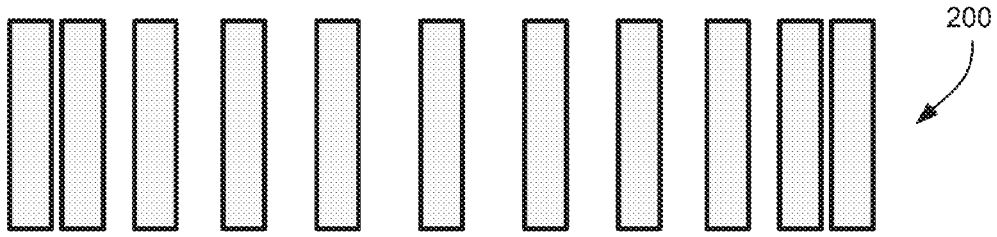
FIG. 5A shows a diagrammatic side view of another example acoustic projector system with non-uniform spacing.
Figure 5B:
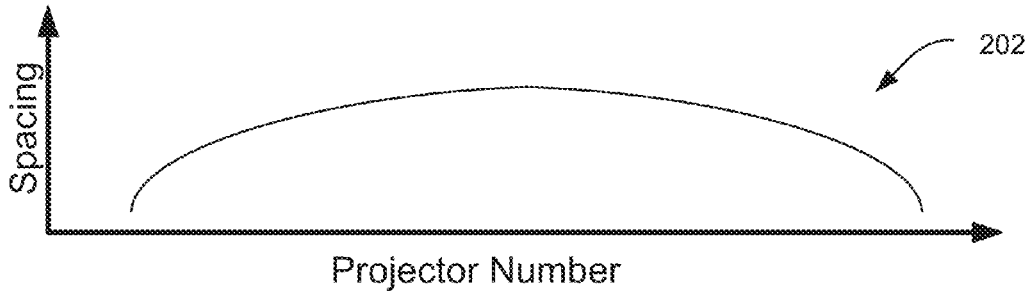
FIG. 5B graphs the spacing between projectors for the example system of FIG. 5A.

Reference is now made to FIG. 5A, which diagrammatically shows another example embodiment of an acoustic projector system 200. The acoustic projector system 200 includes a linear array of projectors 10 with non-uniform spacing between adjacent projectors 10 in the array. FIG. 5B shows a graph 202 illustrating the relative spacing between projectors in the example system 200. The spacing between projectors 10 in this example varies quadratically with distance from the center, as shown in the graph 202.

Figure 6A:
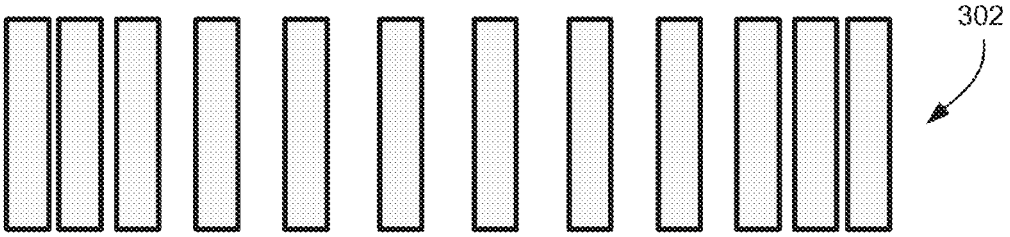
FIG. 6A shows a diagrammatic side view of yet a further example acoustic projector system with non-uniform spacing.
Figure 6B:
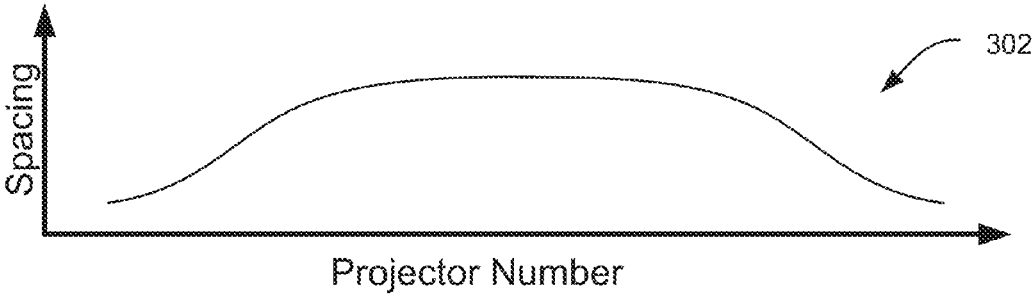
FIG. 6B graphs the spacing between projectors for the example system of FIG. 6A.

Reference is now made to FIG. 6A, which diagrammatically shows yet a further example embodiment of an acoustic projector system 300. The acoustic projector system 300 includes a linear array of projectors 10 with non-uniform spacing between adjacent projectors 10 in the array. FIG. 6B shows a graph 302 illustrating the relative spacing between projectors in the example system 300. The spacing between projectors 10 has a higher-order non-uniform variation with distance from the center, as shown in the graph 202. The spacing may be selected using finite element analysis in some embodiments.

In all three examples, the spacing between the projectors 10 near the center is the widest/largest spacing, and the spacing between the projectors near the ends of the array is the smallest/closest spacing.

It will be appreciated that the number of projectors 10 shown in the examples is illustrative only and that other implementations may feature fewer or more projectors 10.

Figure 7:
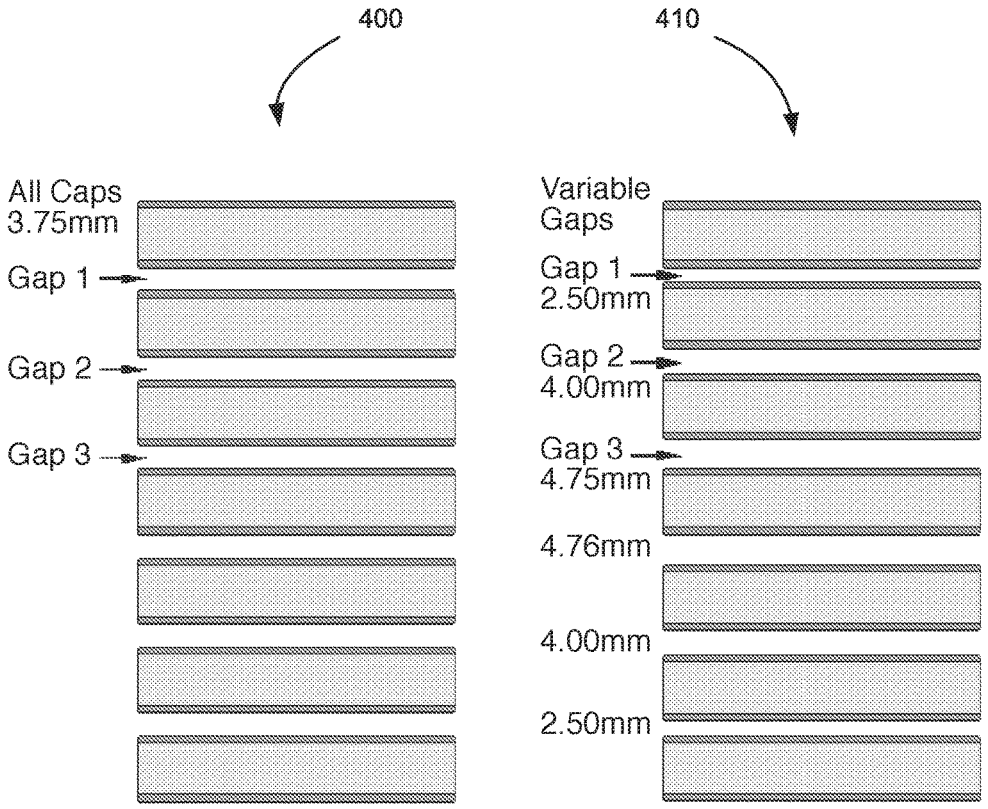
FIG. 7 diagrammatically shows two example acoustic projector systems, one with uniform spacing and one with non-uniform spacing.

Reference is now made to FIG. 7, which shows two example acoustic projector systems. A first example system 400 includes seven projectors 10 in a linear array and in close proximity to form the acoustic projector system 400. The first example acoustic projector system 400 uses uniform spacing between the projectors 10. In this illustrative example, the gap or separation between each pair of adjacent projectors is 3.75 mm.

A second example system 410 also includes seven projectors 10 in a linear array and in close proximity, but uses non-uniform spacing between projectors 10. In particular, the spacing between the projectors 10 near the center of the array is wider than the spacing between the projectors near the ends of the array. In this specific example, the spacing between projectors 1 and 2 and projectors 6 and 7 is 2.50 mm. The spacing between projectors 2 and 3 and projectors 5 and 6 is 4.00 mm. The spacing between projectors 3 and 4 and projectors 4 and 5 is 4.75 mm.

Figure 8:
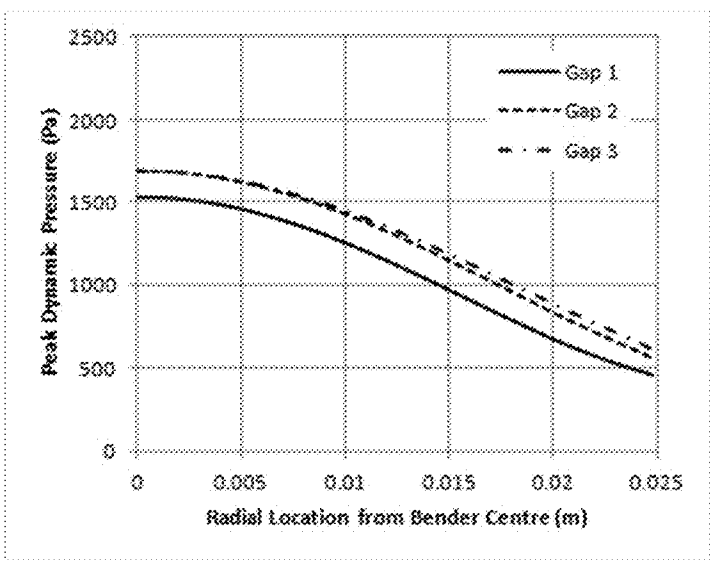
FIG. 8 shows graphs of dynamic pressure distribution for various gaps in the example systems of FIGS. 7.
Figure 8:
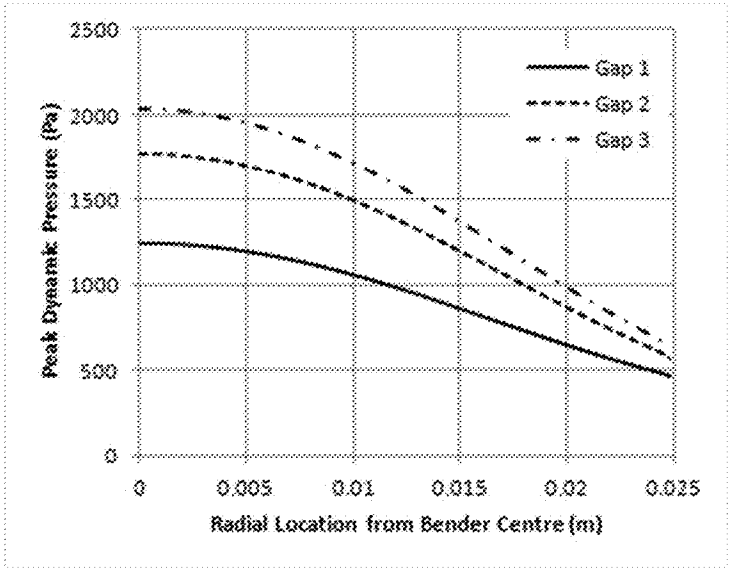

Reference will now also be made to FIG. 8, which shows two graphs 420, 430 illustrating the dynamic pressure distribution measured in three of the gaps for the first example system 400 and the second example system 410, respectively. On each of the graphs 420, 430, the dynamic pressure distribution is shown for gap 1 between projectors 1 and 2, gap 2 between projectors 2 and 3, and gap 3 between projectors 3 and 4. The x-axis in each of the graphs 420, 430, reflects the radial distance from the center of the circular projector face. It will be noted that in all cases, the dynamic pressure is highest at the center of the gap, which is where the greatest deflection of the projectors' faces occurs.

The graph 420 shows that the dynamic pressure for gap 3 is higher than the dynamic pressure experienced in gap 2, and both are higher than the dynamic pressure experienced in gap 1. Graph 430, however, shows that the non-uniform spacing may serve to generally equalize the dynamic pressure distribution. Gaps 1, 2 and 3 all experience similar dynamic pressures in the case of the second example acoustic projector system 410.

Figure 9:
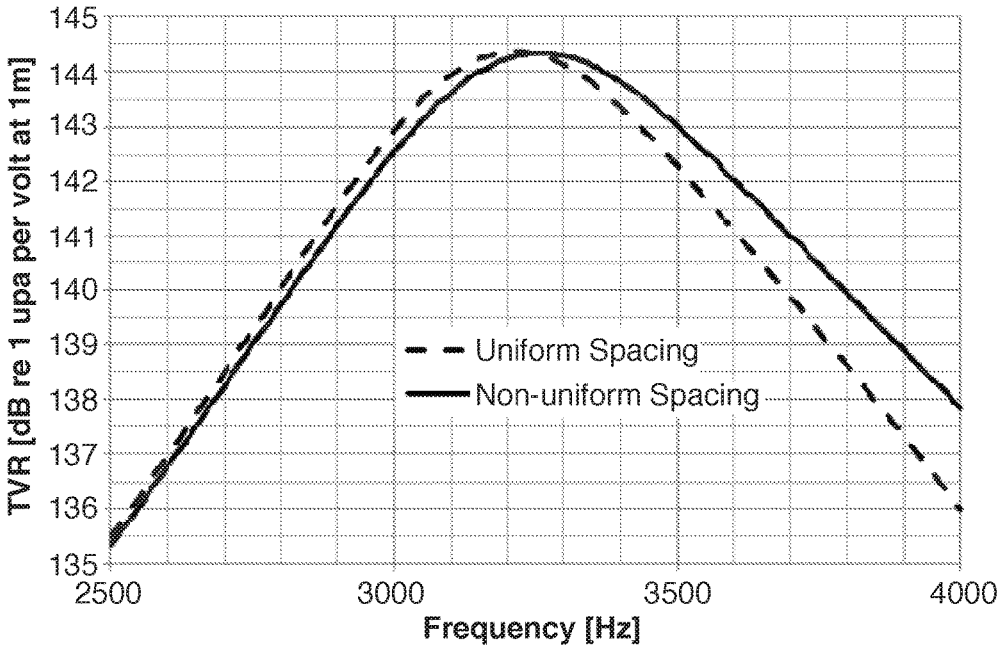
FIG. 9 shows the transmit voltage response of the two example systems of FIG. 7.

Reference is now also made to FIG. 9, which illustrates the transmit voltage response (TVR) for both the first example acoustic projector system 400 and the second example acoustic projector system 410. The TVR for both examples is very similar, showing that the resonant frequency and bandwidth is largely maintained despite the change in spacing from uniform to non-uniform spacing.

The various embodiments presented above are merely examples and are in no way meant to limit the scope of this disclosure. Variations of the innovations described herein will be apparent to persons of reasonable skill in the art, such variations being within the intended scope of the present application. In particular, features from one or more of the above-mentioned embodiments may be selected to create alternative embodiments comprising a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter herein and in the recited claims intends to cover and embrace all suitable changes in technology.

Certain adaptations and modifications of the described embodiments can be made. Therefore, the above discussed embodiments are considered to be illustrative and not restrictive.

What is claimed is:

1. An underwater acoustic projector system structured to reduce cavitation depth by equalizing acoustic pressure distribution between projectors, comprising:

a plurality of acoustic projectors each being of the same size, each having a diameter and to be driven by the same voltage; and framing that holds the acoustic projectors in a linear array and in close proximity such that the acoustic projectors interact with one another when they produce acoustic pressures, wherein each acoustic projector in the linear array is spaced apart from an adjacent acoustic projector by a respective distance between facing surfaces of the adjacent projectors, wherein close proximity provides that the respective distance is less than the diameter and the diameter is less than one-eighth of a wavelength of an acoustic resonant frequency of the underwater acoustic projector system, and wherein the respective distance between two acoustic projectors proximate the center of the linear array is greater than the respective distance between two acoustic projectors proximate the end of the linear array, and wherein variation in the respective distances between acoustic projectors is symmetrical about the center of the array.

2. The system claimed in claim 1, wherein the respective distance between pairs of adjacent acoustic projectors in the array varies linearly from the center of the array towards either end of the array.

3. The system claimed in claim 1, wherein the respective distance between pairs of adjacent acoustic projectors in the array varies non-linearly from the center of the array towards either end of the array.

4. The system claimed in claim 3, wherein the non-linearity is quadratic.

5. The system claimed in claim 1, wherein the respective distance between a first acoustic projector at a first end of the array and a second acoustic projector adjacent the first acoustic projector is a first distance, and wherein the respective distance between a center acoustic projector at a center of the array and an adjacent projector next to the center acoustic projector is a second distance, and the second distance is greater than the first distance.

6. The system claimed in claim 5, wherein no respective distance between two acoustic projectors in the array is less than the first distance or greater than the second distance.

7. The system claimed in claim 5, and wherein the respective distance between a last acoustic projector at a second end of the array and a second-last acoustic projector adjacent the last acoustic projector is the first distance.

8. The system claimed in claim 1, wherein the acoustic projectors comprise cylindrical piezoelectric acoustic projectors.

9. The system claimed in claim 8, wherein the projectors have a circular face.

10. An underwater acoustic projector system structured to reduce cavitation depth by equalizing acoustic pressure distribution between projectors, comprising:

a linear array of four or more acoustic projectors held in close proximity such that the acoustic projectors interact with one another when they produce acoustic pressures, each projector being of the same size, each projector having a diameter and to be driven by the same voltage, wherein each acoustic projector in the linear array is spaced apart from an adjacent acoustic projector by a respective distance between facing surfaces of the adjacent projectors, wherein close proximity provides that the respective distance is less than the diameter and the diameter is less than one-eighth of a wavelength of an acoustic resonant frequency of the underwater acoustic projector system, and wherein the respective distance between two acoustic projectors proximate the center of the linear array is greater than the respective distance between two acoustic projectors proximate the end of the linear array, and wherein variation in the respective distances between acoustic projectors is symmetrical about the center of the array.

11. The system claimed in claim 10, wherein the respective distance between pairs of adjacent acoustic projectors in the array varies linearly from the center of the array towards either end of the array.

12. The system claimed in claim 10, wherein the respective distance between pairs of adjacent acoustic projectors in the array varies non-linearly from the center of the array towards either end of the array.

13. The system claimed in claim 12, wherein the non-linearity is quadratic.

14. The system claimed in claim 10, wherein the respective distance between a first acoustic projector at a first end of the array and a second acoustic projector adjacent the first acoustic projector is a first distance, and wherein the respective distance between a center acoustic projector at a center of the array and an adjacent projector next to the center acoustic projector is a second distance, and the second distance is greater than the first distance.

15. The system claimed in claim 14, wherein no respective distance between two acoustic projectors in the array is less than the first distance or greater than the second distance.

16. The system claimed in claim 14, and wherein the respective distance between a last acoustic projector at a second end of the array and a second-last acoustic projector adjacent the last acoustic projector is the first distance.

17. The system claimed in claim 10, wherein the acoustic projectors comprise cylindrical piezoelectric acoustic projectors.

18. The system claimed in claim 17, wherein the projectors have a circular face.

19. An underwater acoustic projector system structured to reduce cavitation depth by equalizing acoustic pressure distribution between projectors, comprising:

a plurality of acoustic projection means for generating acoustic waves in water in response to an electric signal, each projection means being of the same size, each projection means having a diameter and to be driven by the same electric signal; and framing means for holding the acoustic projectors in a linear array and in close proximity such that the acoustic projectors interact with one another when they produce acoustic pressures, wherein each acoustic projector in the linear array is spaced apart from an adjacent acoustic projector by a respective distance between facing surfaces of the adjacent projectors, wherein close proximity provides that the respective distance is less than the diameter and the diameter is less than one-eighth of a wavelength of an acoustic resonant frequency of the underwater acoustic projector system, and wherein the respective distance between two acoustic projectors proximate the center of the linear array is greater than the respective distance between two acoustic projectors proximate the end of the linear array, and wherein variation in the respective distances between acoustic projectors is symmetrical about the center of the array.

* * * * *